US008746187B2

(12) United States Patent
Nogawa et al.

(10) Patent No.: US 8,746,187 B2
(45) Date of Patent: Jun. 10, 2014

(54) ENGINE COOLING DEVICE

(75) Inventors: Shinichiro Nogawa, Mishima (JP); Daishi Takahashi, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 99 days.

(21) Appl. No.: 13/513,064

(22) PCT Filed: Dec. 1, 2009

(86) PCT No.: PCT/JP2009/070189

§ 371 (c)(1),
(2), (4) Date: Jun. 26, 2012

(87) PCT Pub. No.: WO2011/067829

PCT Pub. Date: Jun. 9, 2011

(65) Prior Publication Data

US 2012/0266827 A1 Oct. 25, 2012

(51) Int. Cl.
*F02F 1/36* (2006.01)

(52) U.S. Cl.
USPC ..... 123/41.82 R

(58) Field of Classification Search
USPC ..... 123/193.2, 192.5, 41.72, 41.79, 41.82 R, 123/41.44, 41.29
See application file for complete search history.

(56) References Cited

U.S. PATENT DOCUMENTS

| | | | | |
|---|---|---|---|---|
| 4,381,736 | A * | 5/1983 | Hirayama | 123/41.1 |
| 4,889,079 | A * | 12/1989 | Takeda et al. | 123/41.82 R |
| 5,121,714 | A | 6/1992 | Susa et al. | |
| 5,957,103 | A * | 9/1999 | Takami et al. | 123/193.2 |
| 6,810,838 | B1 | 11/2004 | Hellman | |
| 2002/0152972 | A1 | 10/2002 | Iwasaki et al. | |
| 2003/0000487 | A1 | 1/2003 | Schmitt | |
| 2005/0257756 | A1 | 11/2005 | Endoh et al. | |

FOREIGN PATENT DOCUMENTS

| | | | |
|---|---|---|---|
| DE | 102 44 829 | A1 | 4/2004 |
| EP | 1 239 129 | A2 | 9/2002 |
| EP | 1 375 857 | A1 | 1/2004 |
| EP | 1 600 621 | A2 | 11/2005 |
| FR | 2 860 833 | A1 | 4/2005 |
| FR | 2 905 423 | A1 | 3/2008 |
| JP | A-3-242419 | | 10/1991 |
| JP | U-5-30443 | | 4/1993 |

(Continued)

OTHER PUBLICATIONS

Feb. 9, 2010 International Search Report issued in International Patent Application No. PCT/JP2009/070189 (with translation).

(Continued)

*Primary Examiner* — Hung Q Nguyen
(74) *Attorney, Agent, or Firm* — Oliff PLC

(57) ABSTRACT

A cooling apparatus 1A includes an engine 50A having a cylinder head 52A having a head side W/J 521A equipped with partial W/J 521*a*A through 521*d*A individually incorporated into four different cooling systems, first recess/projection portions P capable of generating a flow separation of cooling water in accordance with a change of the flow rate within a range of a maximum flow rate of the cooling water being provided to the head side W/J 521A, and control means for executing a control of changing the flow rate of the cooling water that flows through the first cooling medium passageway in accordance with operating conditions of the engine including a case where the control means partially changes in each of the plurality of the partial cooling medium passageways.

1 Claim, 8 Drawing Sheets

(56) References Cited

FOREIGN PATENT DOCUMENTS

| | | |
|---|---|---|
| JP | A-2002-221080 | 8/2002 |
| JP | A-2002-364456 | 12/2002 |
| JP | A-2005-224042 | 8/2005 |
| JP | A-2005-337035 | 12/2005 |
| JP | A-2007-247523 | 9/2007 |
| JP | A-2007-297923 | 11/2007 |
| JP | A-2009-208569 | 9/2009 |
| WO | WO 02/02917 A1 | 1/2002 |
| WO | WO 2005/003531 A2 | 1/2005 |

OTHER PUBLICATIONS

Bartlett, "The Fundamentals of Heat Exchangers," *The Industrial Physicist*, pp. 18-21, 1996.

Nov. 21, 2013 Extended European Search Report issued in European Patent Application No. 09851837.6.

* cited by examiner

ENGINE COOLING DEVICE

TECHNICAL FIELD

The present invention relates to an engine cooling apparatus.

BACKGROUND ART

Conventionally, an engine is generally cooled by cooling water. In regard to this, Patent Documents 1 and 2 disclose arts considered as arts that are relative to the present invention as arts regarding a water jacket through which water flows. Patent Document 1 discloses a water jacket structure of an engine in which different surface properties of the water jacket formed in the engine are formed in different portions thereof. Patent Document 2 discloses a cooling structure of a cylinder liner in which a ring-shaped fin is provided to an outer circumference surface that forms a water jacket.

PRIOR ART DOCUMENTS

Patent Documents

Patent Document 1: Japanese Patent Application Publication No. 2002-221080

Patent Document 1: Japanese Patent Application Publication No. 2005-337035

SUMMARY OF THE INVENTION

Problems to be Solved by the Invention

Incidentally, an engine, especially, a spark-ignited internal combustion engine generates much heat which is caused by an exhaust loss or a cooling loss and which is not used for the actual work, as shown in FIG. 12. It is very important to reduce the cooling loss having a big ratio in the whole energy loss for improvement in the heat efficiency (the mileage). However, it is not always easy to reduce the cooling loss and to use heat effectively. This prevents improvement in the heat efficiency.

For example, the reason it is difficult to reduce the cooling loss is that a general engine cannot partially change the heat transfer state. That is, it is difficult to cool a part necessary to be cooled by only the necessary degree and to suppress the heat transfer to a portion in which a large cooling loss occurs, in consideration of the structure of the general engine. Specifically, to change the heat transfer state of the engine, the flow rate of the cooling water is changed in response to the engine speed by a mechanical water pump driven by the output of the engine. However, even if the adjustable water pump temporarily changing the flow rate is used as the water pump entirely regulating the flow rate of the cooling water, the heat transfer state cannot be partially changed in response to engine operating conditions.

In this regard, the art disclosed in Patent Document 1 is configured to have different surface shapes of the water jacket in different portions and to thus cool the portions in accordance with requests for cooling. In terms of improvement in the heat efficiency, it is conceivable to suppress the degree of cooling a portion under a specific engine operating condition even when this portion has a high request for cooling. However, the art disclosed in Patent Document 1 has a problem because appropriate cooling may not be done on the engine portion basis in terms of improvement in the heat efficiency.

Also, for example, it is conceivable that the heat insulation of the engine is raised for reducing cooling loss. In this case, a large reduction of the cooling loss can be expected as shown in FIG. 13. However, the improvement of the heat insulation also raises the inner wall temperature of the combustion chamber at the same time. Further, in this case, this raises the temperature of the air-fuel mixture, thereby causing a problem of knocking.

Thus, the present invention has been made in view of the above circumstances and has an object to provide an engine cooling apparatus capable of reduction in cooling loss by partially changing the heat transfer state of the engine in a rational manner and further capable of both reduction in cooling loss and improvement in knocking.

Means for Solving the Problems

The present invention for solving the above problems is an engine cooling apparatus comprising: an engine having a cylinder head having a first cooling medium passageway having a plurality of partial cooling medium passageways individually incorporated into a plurality of different cooling systems, first recess/projection portions capable of generating a flow separation of a cooling medium in accordance with a change of a flow rate within a range of a maximum flow rate of the cooling medium being provided in the first cooling medium passageway; and control means for executing a control of changing the flow rate of the cooling medium that flows through the first cooling medium passageway in accordance with operating conditions of the engine including a case where the control means partially changes in each of the plurality of the partial cooling medium passageways.

Also, the present invention is preferably configured so that when the operating conditions of the engine are low-speed, high-load conditions, the control means performs a control of changing the flow rate of the cooling medium caused to flow through the first cooling medium passageway to a flow rate that generates the flow separation of the cooling medium by the first recess/projection portions.

Also, the present invention is preferably configured so that the engine further includes a cylinder block having a second cooling medium passageway formed in the periphery of a cylinder, second recess/projection portions capable of generating a flow separation of the cooling medium in accordance with a change of the flow rate with the maximum flow rate of the cooling medium being provided on a wall surface of the second cooling medium passageway located on a cylinder side; and the control means executes a control of changing the flow rate of the cooling medium that flows through the second cooling medium passageway to a flow rate that does not generate the flow separation of the cooling medium that flows through the second cooling medium passageway by the second recess/projection portions when the operating conditions of the engine are low-speed, high-load conditions.

Also, the present invention is an engine cooling apparatus comprising: an engine having a cylinder block having a cooling medium passageway in the periphery of a cylinder, a recess/projection portion capable of changing a thermal conductivity to cooling water in accordance with a change of a flow direction of the cooling water being provided in the cooling medium passageway; cooling capacity control means capable of controlling a cooling capacity of the cylinder head; flow direction changing means capable of changing the flow direction of the cooling water in the cooling medium passageway between a first direction and a second direction having a higher thermal conductivity due to the recess/projection portion; and control means for performing a control of suppressing the cooling capacity of the cylinder head by controlling the cooling capacity control means and changing the flow direction of the cooling water in the cooling medium passageway by controlling the flow direction changing means when the operating conditions of the engine are low-speed, high-load conditions.

According to the present invention, in cooling loss can be reduced by partially changing the heat transfer state of the engine in a rational manner and both reduction in cooling loss and improvement in knocking can be achieved.

BRIEF DESCRIPTION OF THE DRAWINGS

FIG. 13 illustrates a case where the cylinder wall thickness is increased and its material is changed and a case where air insulation is performed with high performance, as the case of the high insulation; and FIG. 13 illustrates a general engine provided with a cooling water circulation passageway of one system through which cooling water flows from a cylinder block lower portion to a head against gravitational force.

MODES FOR CARRYING OUT THE INVENTION

Embodiments according to the present invention will be described in detail with reference to the drawings. As described below, according to an aspect of the present invention, on the basis of a knowledge that heat insulation of the head is effective to reduce the cooling loss, and cooling of the block is effective to improve knocking, the invention includes means for realizing a new concept of heat isolation of the head and cooling of the block that was not presented conventionally.

Figure 1:
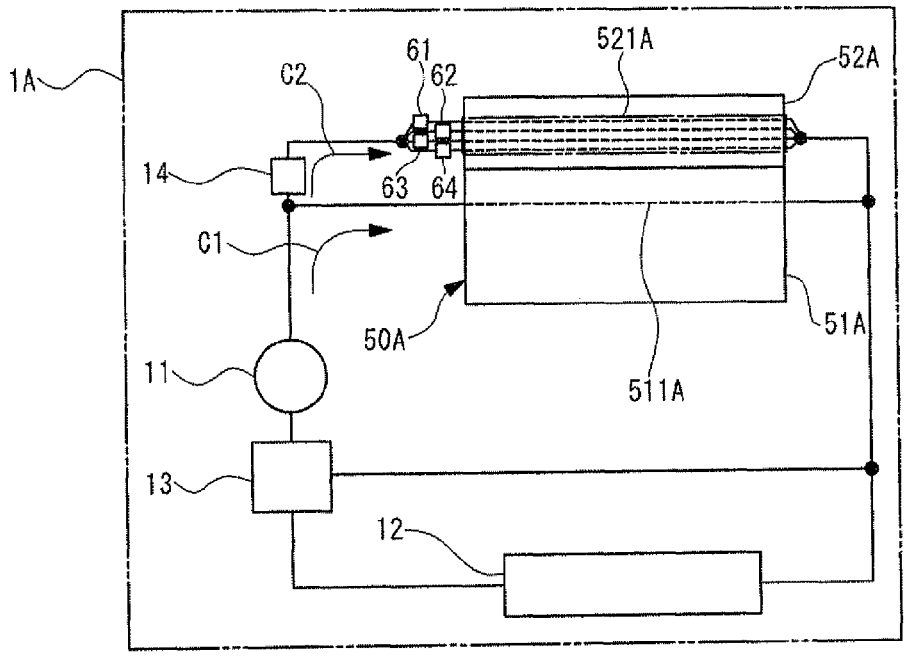
FIG. 1 is a schematic view of an engine cooling apparatus (hereinafter, simply referred to as cooling apparatus) 1A.

A cooling apparatus 1A shown in FIG. 1 is mounted on a vehicle not illustrated, and is provided with a water pump (hereinafter, referred to as W/P) 11, a radiator 12, a thermostat 13, a flow rate control valve 14, an engine 50A, and first through fourth partial flow rate control valves 61 through 64. The W/P 11 corresponds to cooling medium pumping means, and is an adjustable W/P feeding the cooling water as a cooling medium with pressure and changing the flow rate thereof. Also, the W/P 11 is a first flow changing means capable of changing the flow state of water through the engine 50A, and is specifically a flow changing means capable of wholly controlling the flow velocity of the cooling water that flows through the engine 50A by entirely controlling the flow rate of the cooling water that flows through the engine 50A. The cooling water pumped by the W/P 11 is supplied to the engine 50A.

The engine 50A includes a cylinder block 51A and a cylinder head 52A. The cylinder block 51A is provided with a block side water jacket (hereinafter, referred to as block side W/J) 511A, which is a cooling medium passageway. The block side W/J 511A forms a single cooling system in the cylinder block 51A. On the other hand, the cylinder head 52A is provided with a head side water jacket (hereinafter, referred to as head side W/J) 521A, which is a cooling medium passageway. The head side W/J 521A forms a plurality of (herein, four) different cooling systems at the cylinder head 52A. The head side W/J 521A corresponds to a first cooling medium passageway, and the block side W/J 511A corresponds to a second cooling medium passageway. Specifically, the cooling water pumped by the W/P 11 is supplied to the block side W/J 511A and the head side W/J 521A.

In this regard, a plurality of cooling water circulation passageways are provided in the cooling apparatus 1A. For example, for a cooling water circulation passageway, there is a block side circulation passageway C1 into which the block side W/J 511A is incorporated. After the cooling water is discharged from the W/P 11, the cooling water flowing into this block side circulation passageway C1 flows through the block side W/J 511A, and returns to the W/P 11 either via the thermostat 13 or via the radiator 12 as well as the thermostat 13. The radiator 12 is a heat exchanger, and exchanges heat between the flowing cooling water and air to cool the cooling water. The thermostat 13 switches flow passageways communicating with the entrance side of the W/P 11. Specifically, the thermostat 13 permits the flow passageway bypassing the radiator 12 to be in the communication state, when the cooling water temperature is less than a predetermined value. The thermostat 13 permits the flow passageway circulating with the radiator 12 to be in a communication state, when the cooling water temperature is equal to or more than the predetermined value.

Also, for example, for a cooling water circulation passageway, there is a head side circulation passageway C2 which is the circulation passageway into which the head side W/J 521A is incorporated. After the cooling water is discharged from the W/P 11, the cooling water flowing into this head side circulation passageway C2 flows into the flow rate control valve 14, at least any one of the partial flow rate control valves 61 through 64, and at least any one of the four cooling water systems formed in the head side W/J 521A, and then returns to the W/P 11 either via the thermostat 13 or via the thermostat 13 and the radiator 12. The flow rate control valve 14 is provided in a portion of the head side circulation passageway C2 that is located after the circulation passageway branches into the circulation passageways C1 and C2 and is located at the upstream side of the cylinder head 52A, and is provided more specifically at the upstream sides of the first through fourth partial flow rate control valves 61 through 64.

The flow rate control valve 14 is a second flow changing means capable of changing the flow state of the cooling water in the cylinder head 52A. In this regard, specifically, the flow rate control valve 14 is a flow changing means capable of wholly controlling the flow velocity of the cooling water that flows through the head side W/J 521A by controlling the flow rate of the cooling water that flows through the head side W/J 521A.

The flow rate control valve 14 is a flow changing means capable of simultaneously controlling the flow velocity of the cooling water that flows through the block side W/J 511A by controlling the flow rate of the cooling water that flows through the head side W/J 521A. Specifically, the flow rate control valve 14 is a flow changing means capable of controlling the flow velocity of the cooling water that flows through the block side W/J 511A to increase when controlling the flow velocity of the cooling water that flows through the head side W/J 521A to decrease.

The first through fourth partial flow rate control valves 61 through 64 are provided between the flow rate control valve 14 and the cylinder head 52A in the head side circulation passageway C2 so as to correspond to the four cooling systems of the head side W/J 521A. The partial flow rate control valves 61 through 64 are a third flow changing means capable of changing the flow state of the cooling water in the cylinder head 52A, and is specifically a flow changing means capable of partially controlling the flow velocity of the cooling water that flows through the head side W/J 521A by partially controlling the flow rate of the cooling water that flows through the head side W/J 521A.

In the cooling apparatus 1A, after the cooling water circulating through the block side circulation passageway C1 is pumped by the W/P 11, the cooling water does not flow to the head side W/J 521A before the cooling water fully circulates. Further, in the cooling apparatus 1A, after the cooling water circulating through the head side circulation passageway C2 is pumped by the W/P 11, the cooling water does not flow into the block side W/J 511A before the cooling water fully circulates. That is, in the cooling apparatus 1A, the block side W/J 511A and the head side W/J 521A are respectively incorporated into mutually different cooling medium circulation passageways.

Figure 2:
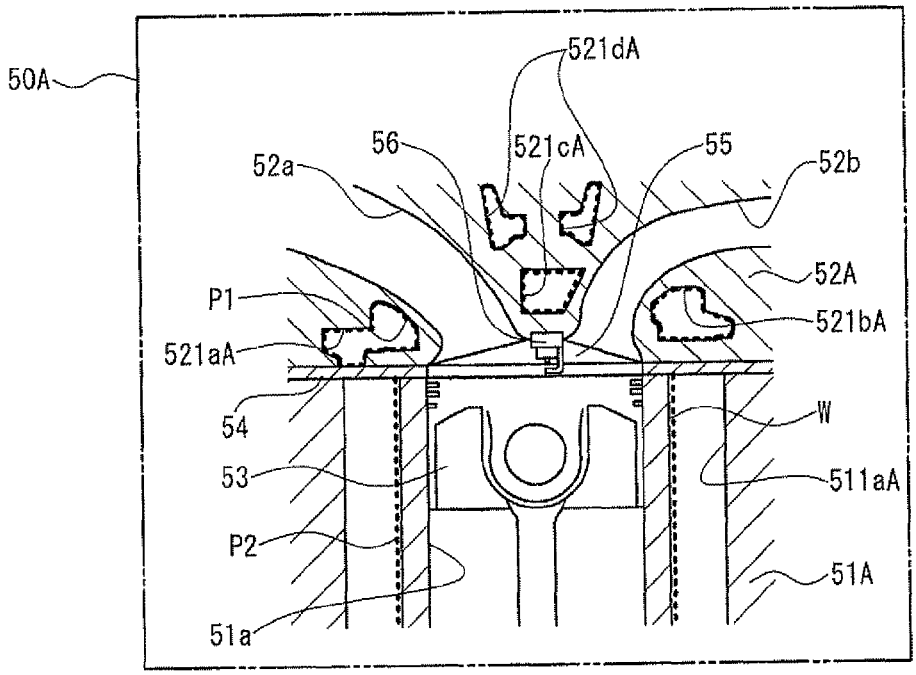
FIG. 2 is a schematic view of a cross section of a cylinder of an engine 50A.

Next, the engine 50A will be explained in more detail. As shown in FIG. 2, a cylinder 51*a* is formed in the cylinder block 51A. A piston 53 is provided in the cylinder 51*a*. The cylinder head 52A is fixed to the cylinder head 52A through a gasket 54. The gasket 54 suppresses heat transfer from the cylinder block 51A to the cylinder head 52A due to its high heat insulation. The cylinder 51*a*, the cylinder head 52A and the piston 53 form a combustion chamber 55. The cylinder head 52A is provided with an intake port 52*a* leading intake air to the combustion chamber 55 and an exhaust port 52*b* exhausting combustion gases from the combustion chamber 55. A spark plug 56 is provided in the cylinder head 52A so as to substantially face the upper and center of the combustion chamber 55.

The block side W/J 511A includes a partial W/J 511*a*A corresponding to a partial cooling medium passageway. Specifically, the partial W/J 511*a*A is a cooling medium passageway provided in the periphery of the cylinder 51*a*. From a viewpoint of appropriately cooling the intake air, an upstream portion of the partial W/J 511*a*A is provided so as to correspond to a portion of the wall surface of the cylinder 51*a* that is hit by the intake air that has flown into the cylinder 51*a*. In this regard, the engine 50A generates a forward tumble flow in a cylinder, and the portion that is hit by the intake air that has flow into the cylinder corresponds to the upper portion of the wall surface of the cylinder 51*a* and to the exhaust side.

The head side W/J 521A specifically includes multiple parts of a partial W/J 521*a*A, a partial W/J 521*b*A, a partial W/J 521*c*A, and a partial W/J 521*d*A corresponding to partial cooling medium passageways. The partial W/J 521*a*A corresponds to a cooling medium passageway provided in the periphery of the intake port 52*a*. The partial W/J 521*b*A corresponds to a cooling medium passageway provided in the periphery of the exhaust port 52*b*. The partial W/J 521*c*A corresponds to a cooling medium passageway provided in the periphery of the spark plug 56. The partial W/J 521*d*A corresponds to a cooling medium passageway provided for cooling a portion between the intake and exhaust ports 52*a* and 52*b* and another portion. The partial W/J 521*a*A through the partial W/J 521*d*A are respectively incorporated into the four cooling systems of the head side W/J 521A. The first partial flow rate control valve 61 is provided so as to correspond to the partial W/J 521*a*A, and the second partial flow rate control valve 62 is provided so as to correspond to the partial W/J 521*b*A, the third partial flow rate control valve 63 being provided so as to correspond to the partial W/J 521*c*A, and the fourth partial flow rate control valve 64 being provided so as to correspond to the partial W/J 521*d*A.

The partial W/J 521*a*A through the partial W/J 521*d*A are respectively provided with first recess/projection portions P1 capable of generating flow separation of the cooling water in accordance with a change of the flow velocity. In this regard, specifically, the first recess/projection portions P1 are provided on the entire inner wall surfaces of the partial W/J 521*a*A through the partial W/J 521*d*A. The partial W/J 511*a*A is provided with a second recess/projection portion P2 capable of generating flow separation of the cooling water in accordance with change of the flow velocity. In this regard, specifically, the second recess/projection portion P2 is provided on the entire inner wall surface W of the partial W/J 511*a*A located on the cylinder 51*a* side.

Figure 3A:
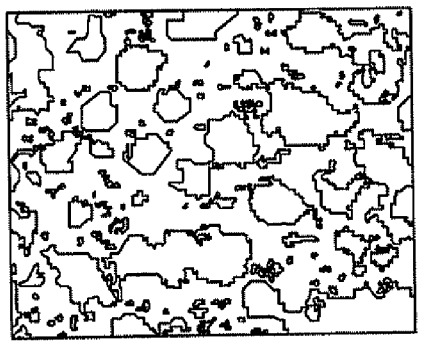
FIGS. 3(*a*) and 3(*b*) are views of exemplary first and second recess/projection parts P1 and P2, and specifically, FIG. 3(*a*) illustrates an uneven porous shape, and FIG. 3(*b*) illustrates an even porous shape.
Figure 3B:
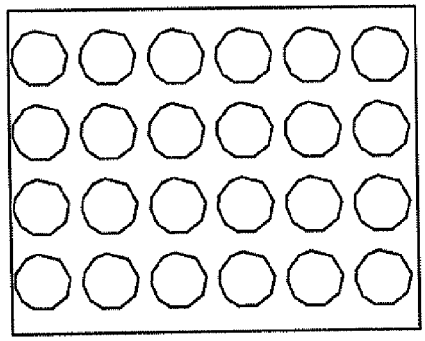

Specifically, the first and second recess/projection portions P1 and P2 are formed by porous shapes. The detailed shapes of the first and second recess/projection portions P1 and P2 are not limited to particular shapes but may have a recess/projection or a surface roughness capable of generating flow separation of the cooling water in accordance with change of the flow velocity within the range of the maximum flow velocity of the cooling water that can be applied in the engine operation (that is, capable of preventing the occurrence of flow separation of the cooling water at a flow velocity equal to or less than a predetermined flow velocity within the range of the maximum flow velocity of the cooling water that can be applied in the engine operation and capable of generating flow separation of the cooling water at a flow velocity larger than the predetermined flow velocity). For example, the concrete shapes of the first and second recess/projection portions P1 and P2 may be uneven porous shapes as illustrated in FIG. 3(*a*) or may be even porous shapes as illustrated in FIG. 3(*b*). Exemplary concrete porous shapes may be formed by a plurality of minute column-shaped holes.

Figure 4:
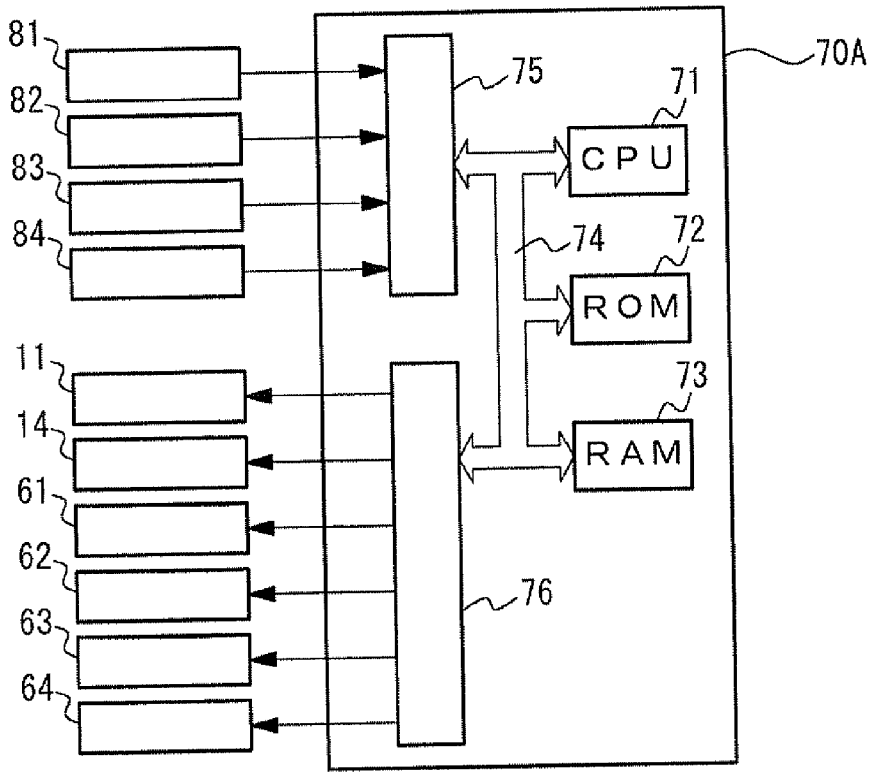
FIG. 4 is a schematic view of an ECU 70A.

Additionally, the cooling apparatus 1A includes an ECU (Electronic Control Unit) 70A shown in FIG. 4. The ECU 70A includes a microcomputer of a CPU 71, a ROM 72, a RAM 73, and the like, and input-output circuits 75 and 76. These configurations are connected to each other via a bus 74. The ECU 70A is electrically connected with various sensors or switches such as a crank angle sensor 81 for detecting the speed of the engine 50A, an air flow meter 82 for measuring the amount of air intake, an accelerator opening sensor 83 for detecting the degree of an accelerator opening, and a water temperature sensor 84 for detecting the temperature of the cooling water. The ECU 70A detects the load of the engine 50A based on the outputs of the air flow meter 82 and the accelerator opening sensor 83. Also, the ECU 70A is electrically connected with various control objects such as the W/P 11, the flow rate control valve 14, and the first through fourth partial flow rate control valves 61 through 64.

The ROM 72 stores map data or programs about a variety of a process performed by the CPU 71. The CPU 71 processes based on a program stored in the ROM 72 and uses a temporary memory area of the RAM 73 as necessary, whereby the ECU 70A functions as various means such as control means, determination means, detecting means, and calculating means.

For example, the ECU 70A functionally realizes control means for controlling the cooling capacity of the cylinder head 52A.

As a control of the cooling capacity of the cylinder head 52A, the control means is realized to perform a control of suppressing the cooling capacity of the cylinder head 52A when the engine is running at high loads (more specifically, r low-speed, high-load conditions).

Also, at this time, specifically, the control means is realized to perform a control of suppressing the cooling capacity of the cylinder head 52A without suppressing the cooling capacity of the cylinder block 51A.

In this regard, in the control of the cooling capacity of the cylinder head 52A, specifically, the control means is realized to perform a control of changing the state of the heat transfer from the cylinder head 52A to the cooling water. More specifically, the control means is realized to perform a control of changing the flow velocity of the cooling water caused to flow through the head side W/J 521A in accordance with the engine operating conditions including a case where the flow velocity is partially changed in each of the partial W/J 521*a*A through the partial W/J 521*d*A. Also, specifically, the control means is realized to perform a control of changing the state of the heat transfer from the cylinder head 52A to the cooling water by controlling the W/P 11, the flow rate control valve 14 and the partial flow rate control valves 61 through 64 as controlled objects.

In the control of suppressing the cooling capacity of the cylinder head 52A, the control means is realized to perform a control of changing the state of the heat transfer from the cylinder head 52A to the cooling water. Specifically, the control means is realized to perform a control of suppressing the heat transfer from the cylinder head 52A to the cooling water in a case where the engine is running at high loads (more especially, at low-speed, high-load conditions). More specifically, the control means is realized to perform a control of changing the flow velocity of the cooling water caused to flow through the head side W/J 521A to a flow velocity at which flow separation of the cooling water is generated on the first recess/projection portion P1.

In the control of suppressing the cooling capacity of the cylinder head 52A without suppressing the cooling ability of the cylinder block 51A, the control means is realized to perform a control of suppressing the heat transfer from the cylinder head 52A to the cooling water without suppressing the heat transfer from the cylinder block 51A to the cooling water. Specifically, the cooling means is realized is realized to perform a control of changing the flow velocity of the cooling water caused to flow through the head side W/J 521A to a velocity that generates the flow separation of the cooling water by the first recess/projection portion P1 and changing the flow velocity of the cooling water caused to flow through the block side W/J 511A to a flow velocity that does not generate flow separation of the cooling water by the second recess/projection portion P2.

Further, the control means is realized to perform a control of establishing operations of the engine 50A at operating conditions other than the high-load engine conditions.

Figure 5:
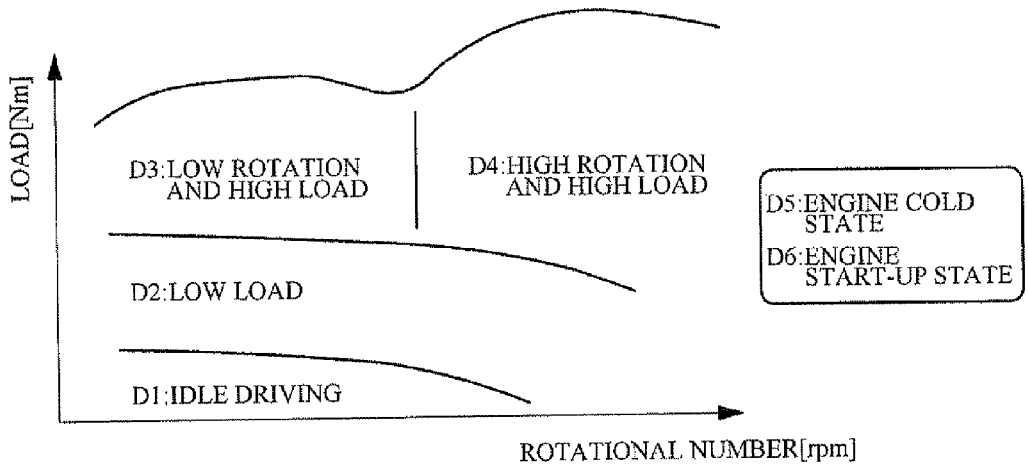
FIG. 5 is a schematic view of categories of the engine operating conditions.

In this regard, the engine operating conditions are classified into six divisions D1 to D6 as illustrated in FIG. 5, in association with the speed and load of the engine 50A, the cold operating conditions, and the engine startup conditions. In control of the control means, the control means sets requirements to be satisfied in each of the divisions D1 to D6, and control indications for satisfying the set requirements.

When the engine operating condition is an idle condition corresponding to the division D1, two requirements are set for improving a combustion speed by raising the intake air temperature, and for raising an exhaust gas temperature for activation of catalyst. Regarding this, two control indications are set for raising the temperatures of the intake port 52*a* and the upper portion of the cylinder 51*a*, and for raising the temperature of the exhaust port 52*b*.

In this regard, to raise the temperature of the intake port 52*a*, for example, the W/P 11 or the flow rate control valve 14 may be controlled to have a flow velocity of the cooling water that generates the flow separation in the whole head side W/J 521A or the partial W/J 521*a*A.

Also, to raise the temperature of the upper portion of the cylinder 51*a*, for example, the W/P 11 or the flow rate control valve 14 may be controlled to have a flow velocity of the cooling water that generates the flow separation in the block side W/J 511A.

Also, to raise the temperature of the exhaust port 52*b*, for example, the W/P 11, the flow rate control valve 14 or the partial flow rate control valve 62 may be controlled to have a flow velocity of the cooling water that generates the flow separation in the whole head side W/J 521A or the partial W/J 521*b*A.

Further, when the engine is running at low loads corresponding to the division D2, two requirements are set for improving the heat efficiency (reducing the cooling loss), and for improving the combustion speed by raising the intake air temperature. Regarding this, two control indications are set for insulating the cylinder head 52A, and for raising the temperatures of the intake port 52*a* and the upper portion of the cylinder 51*a*.

In this regard, to insulate the cylinder head 52A, for example, the W/P 11 or the flow rate control valve 14 may be controlled to have a flow velocity of the cooling water that generates the flow separation in the head side W/J 521A.

Further, to raise the temperature of the intake port 52*a*, for example, the W/P 11, the flow rate control valve 14 or the partial flow rate control valve 61 may be controlled to have a flow velocity of the cooling water that generates the flow separation in the whole head side W/J 521A or 521*a*A.

Furthermore, to increase the temperature of the upper portion of the cylinder 51*a*, for example, the W/P 11 or the flow rate control valve 14 may be controlled to have a flow velocity of the cooling water that generates the flow separation in the block side W/J 511A.

Further, when the engine is running at low-speed, high-load conditions corresponding to the division D3, the requirements are set for reducing the knocking and for improving the heat efficiency (reducing the cooling loss). Regarding this, there are set two control indications for cooling the intake port 52*a* and the upper portion of the cylinder 51*a* and for insulating the cylinder head 52A.

In this regard, in order to cool the intake port 52*a*, for example, the W/P 11, the flow rate control valve 14 or the partial flow rate control valve 61 may be controlled to have a flow velocity of the cooling water that does not generate flow separation in the whole head side W/J 521A or the partial W/J 521*a*A.

Furthermore, in order to cool the upper portion of the cylinder 51*a*, for example, the W/P 11 or the flow rate control valve 14 may be controlled to have a flow velocity of the cooling water that does not generate flow separation in the block side W/J 511A. Also, in order to thermally insulate the cylinder head 52A, for example, the W/P 11 or the flow rate control valve 14 may be controlled to have a flow velocity of the cooling water that generates the flow separation in the whole head side W/J 521A.

When the engine is running at high-speed, high-load conditions corresponding to the division D4, two requirements are set for ensuring reliability and reducing the knocking. Regarding this, two control indications are set for cooling the periphery of the spark plug 56, the portion between the intake and exhaust ports 52*a* and 52*b* and the exhaust port 52*b*, and for cooling the intake port 52*a*.

In this regard, to cool the periphery of the spark plug 56, the portion between the intake and exhaust ports 52*a* and 52*b*, and the exhaust port 52*b*, for example, the W/P 11, the flow rate control valve 14, or the partial flow rate control valves 62, 63 and 64 may be controlled to have a flow velocity of the cooling water that does not generate flow separation in the whole head side W/J 521A or the partial W/J 521*b*A, 521*c*A and 521*d*A.

Further, in order to cool the intake port 52*a*, for example, the W/P 11, the flow rate control valve 14 or the partial flow rate control valve 61 may be controlled to have a flow velocity of the cooling water that does not generate flow separation in the whole head side W/J 521A or the partial W/J 521*a*A.

In regard to a demand for reducing knocking, for example, the upper portion of the cylinder 51*a* may be cooled beside cooling of the intake port 52*a*. In order to cool the upper portion of the cylinder 51*a*, the W/P 11 or the flow rate control valve 14 may be controlled to have a flow velocity that does not generate flow separation of the cooling water.

When the engine is under the cold conditions that correspond to the division D5, two requirements are set for accelerating warm-up of the engine and improving the combustion speed by raising the temperature of the intake air. Regarding this, two control indications are set for accelerating the heat transfer of the cylinder head 52A and for raising the temperatures of the intake port 52*a* and the upper portion of the cylinder 51*a*.

In this regard, in order to accelerate the heat transfer of the cylinder head 52A, for example, by considering that the cooling water receives heat greatly in the cylinder head 52A, the W/P 11, the flow rate control valve 14, or the partial flow rate control valves 62 and 63 may be controlled to have a flow velocity that does not generate flow separation of the cooling water in the whole head side W/J 521A or the partial W/J 521*b*A and 521*c*A associated with portions having large thermal loads.

Also, in order to raise the temperature of the intake port 52*a*, for example, the W/P 11, the flow rate control valve 14, or the partial flow rate control valves 62 and 63 may be controlled to have a flow velocity that generates the flow separation of the cooling water in the whole block side W/J 511A or the partial W/J 521*a*A.

Also, in order to raise the temperature of the upper portion of the cylinder 51*a*, for example, the W/P 11 or the flow rate control valve 14 may be controlled to have a flow velocity that generates the flow separation of the cooling water in the block side W/J 511A.

When the engine is started in the division D6, two requirements are set for improving the ignition property and for accelerating the fuel vaporization. Regarding this, two control indications are set for raising the temperature of the intake port 52*a*, and for raising the temperatures of the periphery of the spark plug 56 and the cylinder 51*a*.

In this regard, in order to raise the temperature of the intake port 52*a*, for example, the W/P 11, the flow rate control valve 14 or the partial flow rate control valve 61 may be controlled to have a flow velocity that generates the flow separation of the cooling water in the whole head side W/J 521A or the partial W/J 521*a*A.

Also, in order to raise the temperature of the periphery of the spark plug 56, for example, the W/P 11, the flow rate control valve 14 or the partial W/J 521*c*A may be controlled to have a flow velocity that generates the flow separation of the cooling water in the whole head side W/J 521A or the partial W/J 521*c*A.

Further, in order to raise the temperature of the upper portion of the cylinder 51*a*, for example, the W/P 11 or the flow rate control valve 14 may be controlled to have a flow velocity that generates the flow separation of the cooling water in the block side W/J 511A.

Meanwhile, in the cooling apparatus 1A, the control means is realized to control the W/P 11 to basically increase the discharge volume as the speed of the engine 50A increases, in light of the consistency or the simplification of the entire control and to control the partial flow rate control valves 61 through 64 to be fully opened primarily. On the other hand, the flow rate control valve 14 is controlled in the following manner in more detail.

That is, the control means is realized to perform a control of half opening the flow rate control valve 14 and a control of driving the W/P 11 to realize a first discharge volume that generates the flow separation of the cooling water in the block side W/J 511A and the head side W/J 521A in the half-open state of the flow rate control valve 14, when the engine is operating under idle conditions corresponding to the division D1, under the low-load conditions corresponding to the division D2, under cold conditions corresponding to the division D5 and under startup conditions corresponding to the division D6.

Also, the control means is realized to open the flow rate control valve 14 with an opening larger than the half-opening and to perform a control of driving the W/P 11 to realize a second discharge volume that generates the flow separation of the cooling water in the head side W/J 521A while preventing the flow separation of the cooling water in the block side W/J 511A in the above opening state of the flow rate control valve 14, when the engine is operating at low-speed, high-load conditions corresponding to the division D3.

Also, the control means is realized to perform of half opening the flow rate control valve 14 and a control of driving the W/P 11 with a third discharge amount that does not generate the flow separation of the cooling water in the block side W/J 511A and the head side W/J 521A in the half-open state of the flow rate control valve 14, when the engine is running at high-speed, high-load conditions corresponding to the division D4.

In the cooling apparatus 1A, under the control of the control means, the heat transfer from the cylinder head 52A to the cooling water is suppressed and the cooling capacity of the cylinder head 52A is suppressed by generating the flow separation of the cooling water that flows through the cylinder head 52A in the division D3 by the W/P 11 and the flow rate control valve 14. Also, simultaneously, under the control of the control means, the W/P 11 and the flow rate control valve 14 does not generate the flow separation of the cooling water that flows through the cylinder block 51A, whereby the heat transfer from the cylinder head 52A to the cooling water is suppressed without suppressing the heat transfer from the cylinder block 51A to the cooling water. That is, the cooling capacity of the cylinder head 52A is suppressed without suppressing the cooling capacity of the cylinder block 51A.

In this regard, in the cooling apparatus 1A, the W/P 11, the flow rate control valve 14 and the first recess/projection portions P1 form a cooling capacity control means capable of controlling the cooling capacity of the cylinder head 52A, and is specifically a cooling capacity control means capable of suppressing the cooling capacity of the whole cylinder head 52A by generating the flow separation of the cooling water in the whole head side W/J 521A.

Also, in the cooling apparatus 1A, the W/P 11, the flow rate control valve 14, the first recess/projection portions P1 and the second recess/projection portion P2 is a cooling capacity control means capable of controlling the cooling capacity of the whole cylinder head 52A without suppressing the cooling capacity of the cylinder block 51A by generating the flow separation of the cooling water in the whole head side W/J 521A without generating the flow separation of the cooling water in the block side W/J 511A by the W/P 11, the flow rate control valve 14, the first recess/projection portions P1 and the second recess/projection portion P2.

The flow rate control valve 14 may be replaced with the partial flow rate control valves 61 through 64 so that the W/P 11, the partial flow rate control valves 61 through 64 and the first recess/projection portions P1 are caused to function as cooling capacity control means capable of controlling the cooling capacity of the whole cylinder head 52A.

Also, in the cooling apparatus 1A, cooling capacity control means capable of partially controlling the cooling capacity of the cylinder head 52A is formed by the W/P 11, at least the partial flow rate control valves 61 through 64 among the flow rate control valve 14 and the partial flow rate control valves 61 through 64, and the first recess/projection portions P1. Specifically, cooling capacity control means capable of partially suppressing the cooling capacity of the cylinder head 52A is realized by partially generating the flow separation of the cooling water in the partial W/J 521*a*A through 521*d*A.

The control means may be realized to suitably control the W/P 11, the flow rate control valve 14 and the partial flow rate control valves 61 through 64 on the basis of, for example, the above-described control indications and to thus perform controls that are different from the above-described controls in the divisions D1 through D6 and are considered in terms of the consistency and simplification of the entire control. It is thus possible to suitably establish the operations of the engine 50A in the divisions D1 through D6.

Figure 6:
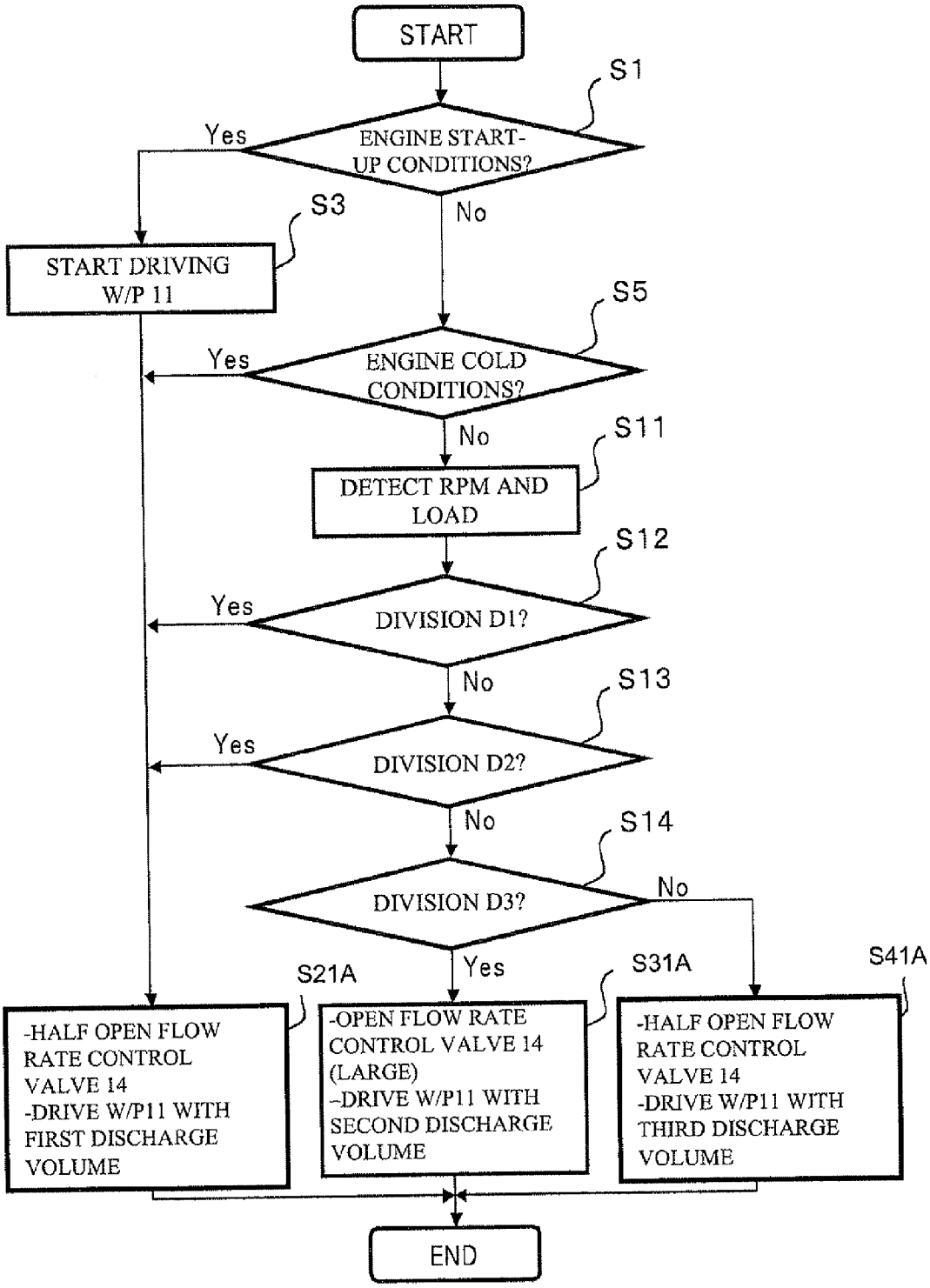
FIG. 6 is a flowchart of an operation of the ECU 70A.

A process performed in the ECU 70A will be described with reference to a flowchart shown in FIG. 6. The ECU 70A determines whether or not the engine 50A has just been started up (step S1). If a positive determination is made, the ECU 70A starts to drive the W/P 11 (step S3). Then, the ECU 70A half opens the flow rate control valve 14, and drives the W/P 11 with the first discharge volume (step S21A). On the other hand, if a negative determination is made in step S1, the ECU 70A determines whether or not the engine 50A is cold (step S5). To determine whether or not the engine 50A is cold may be performed by, for example, determining whether the cooling water temperature is equal to or less than a predetermined value (for example, 75° C.). If a positive determination is made in step S5, the process proceeds to step S21. On the other hand, if a negative determination is made in step S5, the ECU 70A detects the speed and the load of the engine 50A (step S11).

Subsequently, the ECU 70A determines the division corresponding to the detected speed and load (from steps S12 to S14). Specifically, when the division corresponds to the division D1, the process continues to step S21A from the positive determination in S12. When the division corresponds to the division D2, the process continues to step S21A from the positive determination in S13. In contrast, when the division corresponds to the division D3, the process continues to step S31A from the positive determination in S14. In this case, the ECU 70A opens the flow rate control valve 14 with an opening larger than the half-opening and drives the W/P 11 with a second discharge volume (step S31A). Further, when the division corresponds to the division D4, the process continues to step S41A from the negative determination in S14. In this case, the ECU 70A half opens the flow rate control valve 14, and drives the W/P 11 with the third discharge volume (step S41A).

Figure 7:
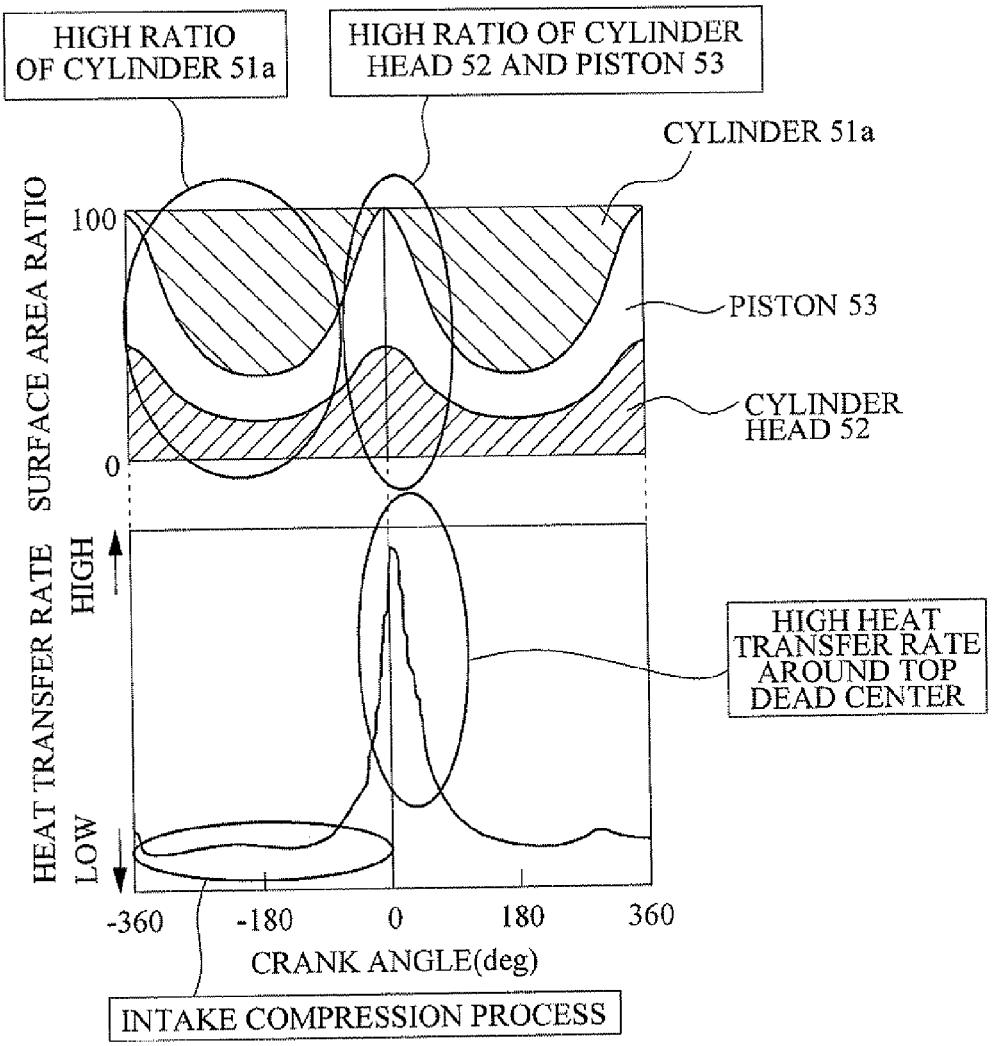
FIG. 7 is a schematic view of a heat transfer coefficient and a surface area ratio of a combustion chamber 55 in association with a crank angle.

Next, the function and effect of the cooling apparatus 1A are described. Now, FIG. 7 shows heat transfer coefficients and surface area ratios of the combustion chamber 55 depending on the crank angle of the engine 50A. As illustrated in FIG. 7, the heat transfer coefficient rises around the top dead center in the compression stroke. The surface area ratio between the cylinder head 52A and the piston 53 rises around the top dead center in the compression stroke. It is thus understood that the temperature of the cylinder head 52A greatly influences the cooling loss. On the other hand, knocking depends on the compression end temperature. It is recognized that the surface area ratio of the cylinder 51*a* is great in the intake compression stroke that influences the compression end temperature. It is thus understood that the temperature of the cylinder 51*a* greatly influences knocking.

In view of this knowledge, in the cooling apparatus 1A, the flow separation of the cooling water is generated in the head side W/J 521A when the engine is running at low-speed, high-load conditions. In this case, the heat transfer from the cylinder head 52A to the cooling water is suppressed because the exchange of the cooling water in the minute structure of the first recess/projection portion P1 is not active greatly and nucleate boiling occurs. Thus, the cooling loss can be reduced.

Meanwhile, the occurrence of knocking is worried about in this case. In the cooling apparatus 1A, the flow separation of the cooling water is generated in the head side W/J 521A without generating the flow separation of the cooling water in the block side W/J 511A. In this case, the minute structure of the second recess/projection portion P2 in the block side W/J 511A contributes to increase in the surface area in contact with the cooling water. Thus, the heat transfer from the cylinder block 51A to the cooling water is accelerated. For this reason, the cooling apparatus 1A can maintain cooling of the cylinder 51*a*, thereby suppressing the knocking.

That is, in the cooling apparatus 1A, the heat transfer state is partially changed in a rational manner based on the above knowledge, thereby insulating the cylinder head 52A (the reduction of the cooling loss). Simultaneously, the cylinder block 51A is cooled and the occurrence of knocking is thus suppressed. Such a way ensures both of the reduction of the cooling loss and the knocking characteristics, thereby improving the heat efficiency.

The cooling apparatus 1A is capable of improving the thermal efficiency mainly at low-speed, high-load conditions and establishing the suitable operations in other operating conditions. In this regard, at high-speed, high-load conditions, the cooling apparatus 1A can ensure the reliability and reduction of knocking, and can further reduce the thermal load applied to the catalyst caused by reduction in the exhaust gas temperature, for example. For this reason, the cooling apparatus 1A can improve the heat efficiency in the entire operating conditions of the engine 50A in addition to the specific operating conditions.

Embodiment 2

Figure 8:
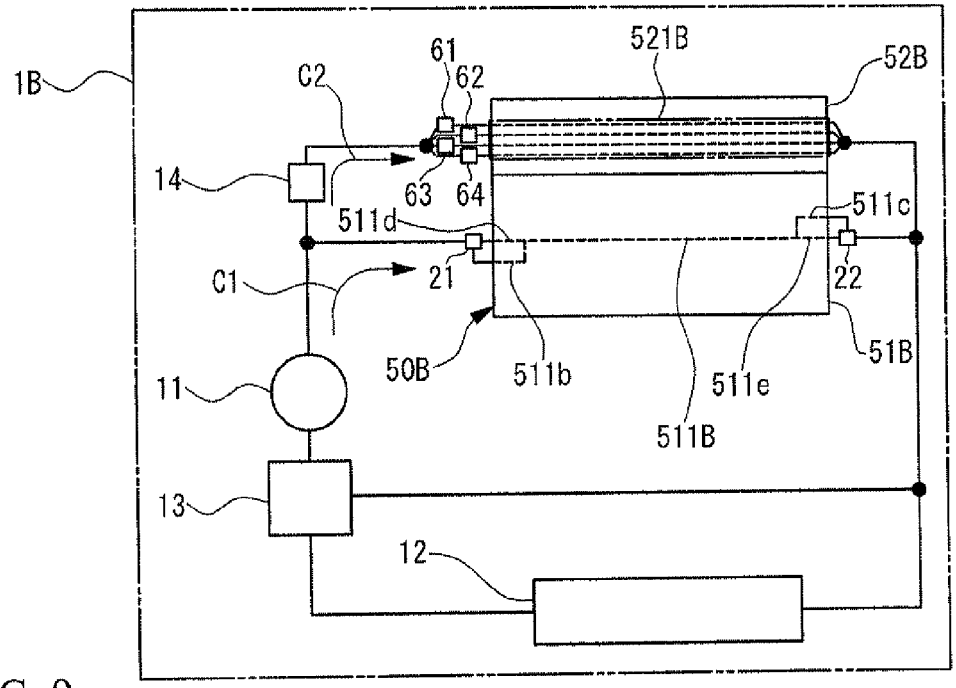
FIG. 8 is a schematic view of a cooling apparatus 1B.

As illustrated in FIG. 8, a cooling apparatus 1B of the present embodiment is substantially the same as the cooling apparatus 1A except that the cooling apparatus 1B is equipped with an engine 50B instead of the engine 50A and an ECU 70B instead of the ECU 70A as will be described later, and is newly equipped with an inlet side switch valve 21 and outlet side switch valve 22.

The engine 50B is substantially the same as the engine 50A except that the engine 50B is equipped with a cylinder block 51B instead of the cylinder block 51A and is equipped with a cylinder head 52B instead of the cylinder head 52A.

The cylinder head 52B is substantially the same as the cylinder head 52A except that a head side W/J 521B is provided instead of the head side W/J 521A. The head side W/J 521B is substantially the same as the head side W/J 521A except that the partial W/J 521*a*A through 521*d*A are replaced by partial W/J 521*a*B through 521*d*B (see FIG. 9). In this regard, the W/J 521*a*B through W/J 521*d*B are substantially the same as the partial W/J 521*a*A through 521*d*A except that the first recess/projection portions P1 are not provided.

Regarding this, in the present embodiment, the flow rate control valve 14 is cooling capacity control means capable of controlling the cooling capacity of the cylinder head 52B. Specifically, the flow rate control valve 14 is cooling capacity control means capable of controlling the cooling capacity of the whole cylinder head 52B by wholly controlling the flow rate of the cooling water that flows through the head side W/J 521B. Instead of the flow rate control valve 14, the partial flow rate control valves 61 through 64 may be caused to function as cooling capacity control means capable of controlling the cooling capacity of the whole cylinder head 52B.

The flow rate control valve 14 provided as described above is cooling capacity control means capable of suppressing the cooling capacity of the cylinder head 52B without suppressing the cooling capacity of the cylinder block 51B. Specifically, for example, when the cylinder block 51B exhibits the original cooling capacity and the cylinder head 52B exhibits the original cooling capacity at high-speed, high-load conditions in which the cooling water is caused to flow through both the cylinder block 51B and the cylinder head 52B, the flow rate control valve 14 is cooling capacity control means capable of suppressing the above cooling capacity of the cylinder head 52B without suppressing the above cooling capacity of the cylinder block 51B.

In the present embodiment, the partial flow rate control valves 61 through 64 are cooling capacity control means capable of controlling the cooling capacity of the cylinder head 52B, and is specifically cooling capacity control means capable of partially controlling the cooling capacity of the cylinder head 52B by partially controlling the flow rate of the cooling water that flows through the head side W/J 521B.

The cylinder block 51B is substantially the same as the cylinder block 51A except that a block side W/J 511B is substituted for the block side W/J 511A. The block side W/J 511B is substantially the same as the block side W/J 511A except that the block side W/J 511B is equipped with a partial W/J 511*a*B instead of the partial W/J 511*a*A, which will be described later, and is equipped, as introduction parts and outflow parts of the cooling water for the partial W/J 511*a*B, with a first introduction part 511*b* and a first outflow part 511*c* and a second introduction part 511*d* and a second outflow part 511*e*. The first introduction part 511*b* and the first outflow part 511*c* are provided to cause the cooling water to flow through the partial W/J 511*a*B in the axial direction of the cylinder 51*a*. The second introduction part 511*d* and the second outflow part 511*e* are provided to cause the cooling water to flow through the partial W/J 511*a*B in the circumferential direction of the cylinder 51*a*. Thus, the block side W/J 511B has a structure in which the flow direction of the cooling water in the partial W/J 511*a*B is switchable between the axial direction of the cylinder 51*a* and the circumferential direction thereof.

The inlet side switch valve 21 is provided on the upstream side of the cylinder block 51B in a portion after the cooling water circulation passageway branches into the first and second cooling water circulation passageways C1 and C2. The outlet side switch valve 22 is provided on the downstream side of the cylinder block 51B and in a portion before the first and second cooling water circulation passageways C1 and C2 join each other. The inlet side switch valve 21 is provided in such a manner that the passageway through which the cooling water flows is switchable between the first introduction part 511*b* and the second introduction part 511*d*, and the outlet side switch valve 22 is provided in such a manner that the passage through which the cooling water flows is switchable between the first outflow part 511*c* and the second outflow part 511*e*.

Figure 9:
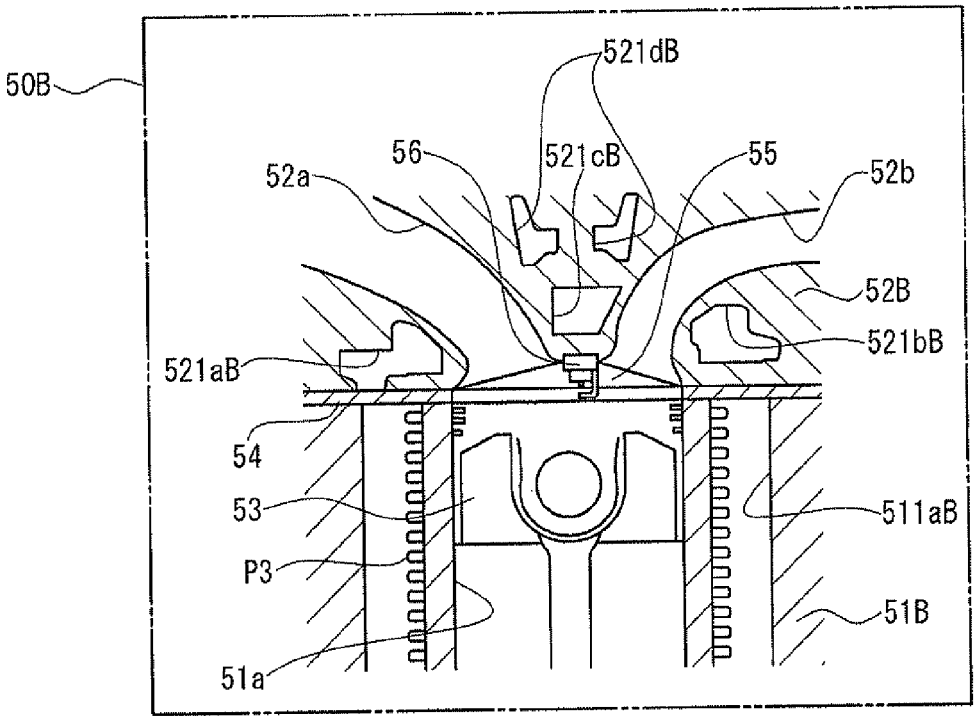
FIG. 9 is a schematic view of a cross section of a cylinder of an engine 50B.

The engine 50B is further described in detail. As depicted in FIG. 9, the partial W/J 511*a*B is provided in the cylinder block 51B instead of the partial W/J 511*a*A. The partial W/J 511*a*B is substantially the same as the partial W/J 511*a*A except that a third recess/projection portion P3 is provided instead of the second recess/projection portion P2, and the flow direction of the cooling water is switched between the axial direction of the cylinder 51*a* and the circumferential direction thereof. The third recess/projection portion P3 is formed into a shape that varies the thermal conductivity from the cylinder block 51B to the cooling water in accordance with the flow direction of the cooling water. Specifically, the third recess/projection portion P3 is formed by a plate-like member in which the member is bent in a wavy form in the axial direction of the cylinder 51*a*, and mountain portions are removed in the circumferential direction at given intervals.

Figure 10A:
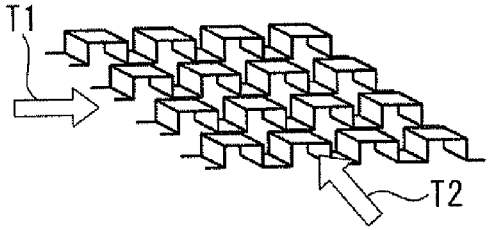
FIGS. 10(*a*) and 10(*b*) are views of exemplary shapes of a third recess/projection portion P3, and specifically, FIG. 10(*a*) illustrates a third recess/projection portion P3 formed by bending a mountain portion into a rectangular shape, and FIG. 10(*b*) illustrates another third recess/projection portion formed by bending a mountain portion into a triangular shape.
Figure 10B:
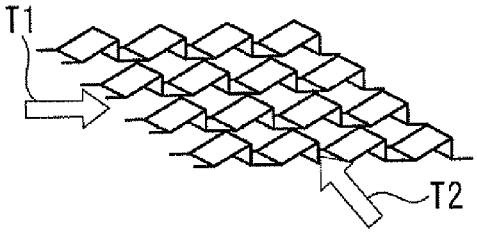

In this regard, for example, the third recess/projection portion P3 may be formed so that mountain portions are bent into a rectangular shape, as depicted in FIG. 10(*a*). Also, as illustrated in FIG. 10(*b*), the third recess/projection portion P3 may be formed so that mountain portions are bent into a triangular shape. The third recess/projection portion P3 has faces that appear when viewed in a first direction T1 in which the third recess/projection portion P3 is bent in a wavy form, and has no face viewed in a second direction T2 orthogonal to the first direction T1. Therefore, the projected area of the third recess/projection portion P3 viewed in the first direction T1 is larger than that viewed in the second direction T2.

Thus, when the cooling water flows in the first direction T1, the bent portions generate the flow separation and decrease the flow rate because the bent portions function as resistance. In contrast, when the cooling water flows in the second direction T2, the flow rate of the cooling water may increase as compared with the case where the cooling water flows in the first direction T1. Also, when the cooling water flows in the second direction T2, the surface area that contacts the cooling water may increase, as compared with the case where the cooling water flows in the first direction T1. Thus, when the cooling water is switched to flow in the second direction T2, the thermal conductivity from the cylinder block 51B to the cooling water can be enhanced, as compared with the case where the cooling water flows in the first direction T1.

The third recess/projection portion P3 is provided on the whole inner wall surface of the partial W/J 511*a*B so that the first direction T1 corresponds to the axial direction of the cylinder 51*a* and the second direction T2 corresponds to the circumferential direction of the cylinder 51*a*. Thus, the third recess/projection portion P3 is provided as a recess/projection portion that varies the thermal conductivity from the cylinder block 51B to the cooling water in accordance with the change of the flow direction between the two orthogonal flow directions (specifically, the axial and circumferential directions of the cylinder 51*a*). Thus, when the cooling water flows in the circumferential direction of the cylinder 51*a*, the third recess/projection portion P3 is provided as a recess/projection portion capable of relatively increasing the thermal conductivity, as compared with the case where the cooling water flows in the axial direction of the cylinder 51*a*. By providing the third recess/projection portion P3 as described above, the switch valves 21 and 22 is flow direction changing means capable of changing the flow direction of the cooling water in the partial W/J 511*a*B between the first direction T1 and the second direction T2 in which the thermal conductivity is higher than that in the first direction T1 due to the third recess/projection portion P3.

The ECU 70B is substantially the same as the ECU 70A except that the switch valves 21 and 22 are electrically connected as control objects, and control means described below is functionally realized. Therefore, an illustration of ECU 70B is omitted.

Similarly, the ECU 70B functionally realizes control means for controlling the cooling capacity of the cylinder head 52B. In the control of suppressing the cooling capacity of the cylinder head 52B, the control means is realized to perform a control of suppressing the cooling capacity of the cylinder head 52B when the engine is operating at high loads (more specifically, under low-speed, high-load conditions). In this regard, the control means is realized to perform a control of suppressing the cooling capacity exhibited based on the head side W/J 521B by controlling the flow rate control valve 14 when the engine is operating at low-speed, high-load conditions.

Further, in the ECU 70B, the control means is realized to perform a control of enhancing the thermal conductivity from the cylinder block 51B to the cooling water when the engine is operating at low-speed, high-load conditions. In the control of enhancing the thermal conductivity, specifically, the control means is realized to control the switch valves 21 and 22 so that the flow direction of the cooling water in the partial W/J 511*a*B is the circumferential direction of the cylinder 51*a*.

The control means is realized to perform a control of establishing operations of the engine 50B in operating conditions other than the engine high-load conditions.

In this regard, the control of the control means may be based on the aforementioned control indications.

When the engine is operating under idle conditions corresponding to the division D1, two control indications are set for raising the temperatures of the intake port 52*a* and the upper portion of the cylinder 51*a*, and for raising the temperature of the exhaust port 52*b*.

In this regard, to raise the temperature of the intake port 52*a*, for example, the flow rate control valve 14 or the partial flow rate control valve 61 may be closed.

To raise the temperature of the upper portion of the cylinder 51*a*, for example, the switch valves 21 and 22 are controlled so that the flow direction of the cooling water in the partial W/J 511*a*B, for example, coincides with the axial direction of the cylinder 51*a*.

To raise the exhaust port 52*b*, for example, the flow rate control valve 14 or the partial flow rate control valve 62 may be closed.

When the engine is operating at low loads corresponding to the division D2, as has been described previously, the two control indications are set for thermally isolating the cylinder head 52B and raising the temperatures of the intake port 52*a* and the upper portion of the cylinder 51*a*.

In this regard, to thermally isolate the cylinder head 52B, for example, the flow rate control valve 14 or the partial flow rate control valves 61 through 64 may be closed. To raise the temperature of the intake port 52*a*, for example, the flow rate control valve 14 or the partial flow rate control valve 61 may be closed. To raise the temperature of the upper portion of the cylinder 51*a*, for example, the switch valves 21 and 22 may be controlled so that the flow direction of the cooling water in the partial W/J 511*a*B coincides with the axial direction of the cylinder 51*a*.

When the engine is operating at low-speed, high-load conditions corresponding to the division D3, the two control indications are set for cooling the intake port 52*a* and the upper portion of the cylinder 51*a* and thermally isolating the cylinder head 52B, as has been described previously.

In this regard, to cool the intake port 52*a*, for example, the flow rate control valve 14 or the partial flow rate control valve 61 may be fully opened. To cool the upper portion of the cylinder 51*a*, for example, the switch valves 21 and 22 may be controlled so that the flow direction of the cooling water in the partial W/J 511*a*B, for example, coincides with the circumferential direction of the cylinder 51*a*. To thermally isolate the cylinder head 52B, for example, the flow rate control valve 14 or the partial flow rate control valves 61 through 64 may be closed.

When the engine is operating at high-speed, high-load conditions corresponding to the division D4, the two control indications are set for cooling the periphery of the spark plug 56, the portion between the intake and exhaust ports 52*a* and 52*b*, and the exhaust port 52*b*, and for cooling the intake port 52*a*.

In this regard, to cool the periphery of the spark plug 56, the portion between the intake and exhaust ports 52*a* and 52*b*, and the exhaust port 52*b*, for example, the flow rate control valve 14, or the partial flow rate control valve 63, the partial flow rate control valve 64 and the partial flow rate control valve 62 are fully opened.

Further, in order to cool the intake port 52*a*, for example, the flow rate control valve 14 or the partial flow rate control valve 61 is fully opened.

Meanwhile, the request for reducing knocking may be achieved by cooling the upper portion of the cylinder 51*a* besides the cooling of the intake port 52*a*. To cool the upper portion of the cylinder 51*a*, the switch valves 21 and 22 may be controlled so that the flow direction of the cooling water in the partial W/J 511*a*B, for example, coincides with the circumferential direction of the cylinder 51*a*.

When the engine is under the cold conditions corresponding to the division D5, the two control indications are set for accelerating the heat transfer to the cylinder head 52B and for raising the temperatures of the intake port 52*a* and the upper portion of the cylinder 51*a*, as has been described previously.

To accelerate the heat transfer to the cylinder head 52B, it is considered that the cooling water receives heat greatly in the cylinder head 52B, and for example, the partial flow rate control valves 62 and 63 associated with portions having a large thermal load may be opened with large openings.

To raise the temperature of the intake port 52*a*, for example, the flow rate control valve 14 of the partial flow rate control valve may be closed.

To raise the upper portion of the cylinder 51*a*, the switch valves 21 and 22 may be controlled so that the flow direction of the cooling water in the partial W/J 511*a*B, for example, coincides with the axial direction of the cylinder 51*a*.

In the engine startup corresponding to the division D6, the two indications are set for raising the temperature of the intake port 52*a* and for raising the temperatures of the periphery of the spark plug 56 and the upper portion of the cylinder 51*a*.

In this regard, to raise the temperature of the intake port 52*a*, for example, the flow rate control valve 14 or the partial flow rate control valve 61 may be closed.

In order to raise the temperature of the periphery of the spark plug 56, for example, the flow rate control valve 14 or the partial flow rate control valve 63 may be closed.

To raise the temperature of the cylinder 51*a*, the switch valves 21 and 22 may be controlled so that the flow direction of the cooling water in the partial W/J 511*a*B, for example, coincides with the axial direction of the cylinder 51*a*, or the W/P 11 may be stopped or driven with a low discharge volume.

Meanwhile, in the cooling apparatus 1B, the control means is realized to control the W/P 11 to basically increase the discharge volume as the speed of the engine 50B increases, in light of the consistency or the simplification of the entire control and to control the partial flow rate control valves 61 through 64 to be fully opened primarily. On the other hand, the flow rate control valve 14 and the switch valves 21 and 22 are controlled in the following manner in detail.

That is, the control means is realized to perform a control of closing the flow rate control valve 14 and to control the switch valves 21 and 22 so that the flow direction of the cooling water in the partial W/J 511*a*B coincides with the axial direction of the cylinder 51*a* when the engine is operating under idle conditions corresponding to the division D1, under the low-load conditions corresponding to the division D2, under cold conditions corresponding to the division D5 and under startup conditions corresponding to the division D6.

Also, the control means is realized to perform a control of closing the flow rate control valve 14 and to control the switch valves 21 and 22 so that the flow direction of the cooling water in the partial W/J 511*a*B coincides with the circumferential direction of the cylinder 51*a*, when the engine is operating at low-speed, high-load conditions corresponding to the division D3.

Also, the control means is realized to perform a control of fully opening the flow rate control valve 14 and to control the switch valves 21 and 22 so that the flow direction of the cooling water in the partial W/J 511*a*B coincides with the circumferential direction of the cylinder 51*a*, when the engine is operating at high-speed, high-load conditions corresponding to the division D4.

In the cooling apparatus 1B, under the control of the control means, the flow rate of the cooling water that flows through the engine 50B is partially lowered by lowering the flow rate of the cooling water that flows through the cylinder head 52B by the flow rate control valve 14 in the division D3.

In the cooling apparatus 1B, the cooling capacity of the cylinder head 52B is suppressed by suppressing the flow of the cooling water to the cylinder head 52B when the flow rate control valve 14 is not fully opened. In this regard, in the cooling apparatus 1B, specifically, the cooling capacity of the cylinder head 52B is suppressed when the flow rate control valve 14 is closed.

The control means may be realized to suitably control the W/P 11, the flow rate control valve 14, the switch valves 21 and 22, and the partial flow rate control valves 61 through 64 on the basis of, for example, the above-described control indications and to thus perform controls that are different from the above-described controls in the divisions D1 through D6 and are considered in terms of the consistency and simplification of the entire control. It is thus possible to suitably establish the operations of the engine SOB in the divisions D1 through D6.

Figure 11:
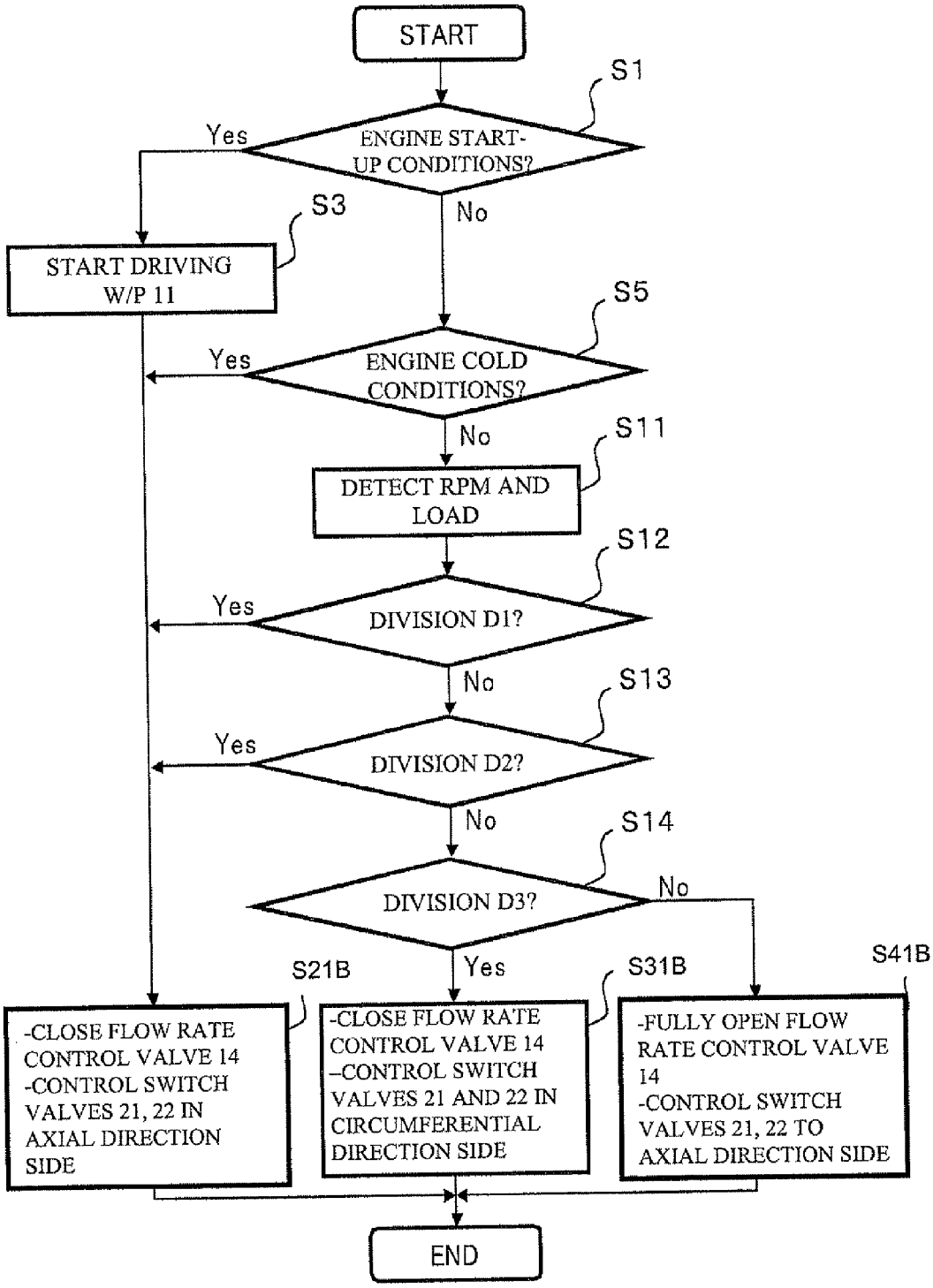
FIG. 11 is a flowchart of an operation of an ECU 70B.
Figure 12:
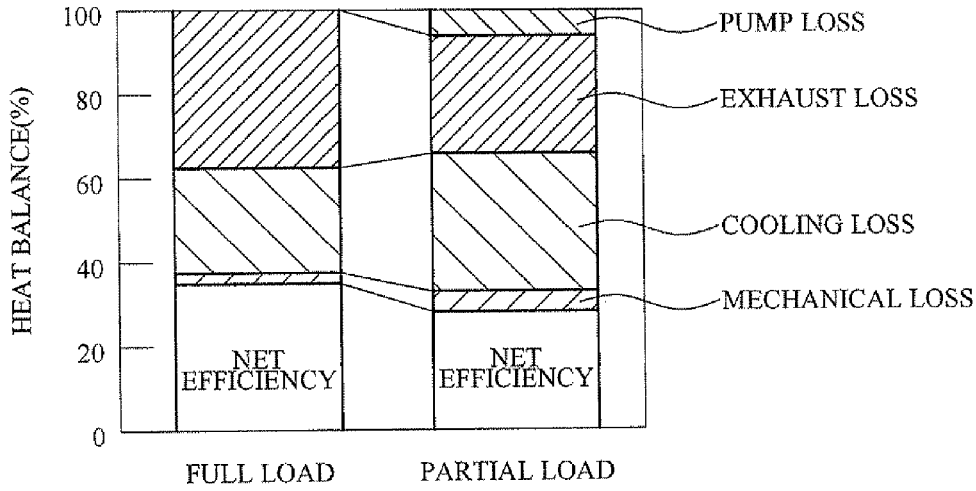
FIG. 12 is a view of a breakdown of the general heat balance of a spark-ignited internal combustion engine in each case of full load and partial load.
Figure 13:
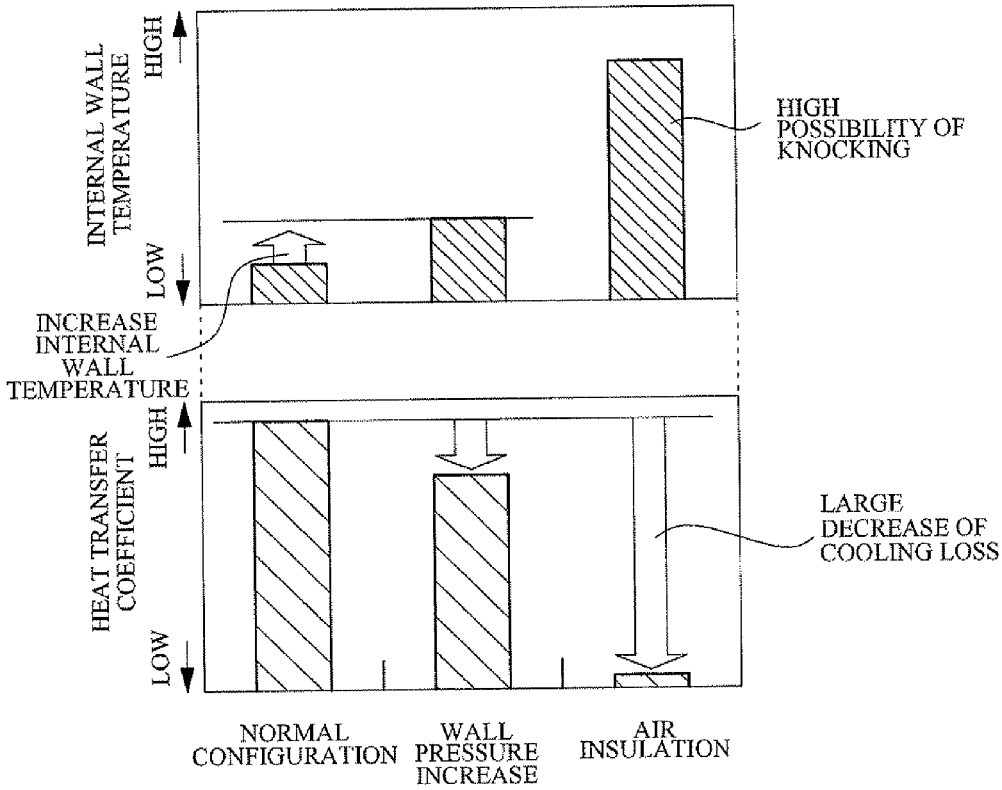
FIG. 13 is a view of inner wall temperature and heat transmissivity of the cylinder in each case of the normal and the high insulation, additionally.

A process performed in the ECU 70B will be described with reference to a flowchart shown in FIG. 11. The present flowchart is the same as the flowchart of FIG. 6 except that step S21B is substituted for step S21A, step S31B is substituted for step S31A, and step S41B is substituted for step S41A. Thus, these steps are specifically described here. Subsequent to step S3, or when a determination is made in step S5, S12 or S13, the ECU 70B closes the flow rate control valve 14 and controls the switch valves 21 and 22 to the axial-direction side of the cylinder 51*a* (step S21B). When a positive determination is made in step S14, the ECU 70B closes the flow rate control valve 14, and controls the switch valves 21 and 22 to the circumferential-direction side of the cylinder 51*a* (step S31B). When a negative determination is made in step S14, the ECU 70B fully opens the flow rate control valve 14, and controls the switch valves 21 and 22 to the circumferential-direction side of the cylinder 51*a* (step S41B).

Next, the function and effect of the cooling apparatus 1B are described. In the cooling apparatus 1B, the flow rate control valve 14 is closed when the engine is operating at low-speed, high-load conditions. Thus, the flow rate of the cooling water that flows through the head side W/J 521B, whereby the cooling capacity of the cylinder head 52B may be suppressed and the cooling loss may be reduced.

Meanwhile, the occurrence of knocking is concerned. For this, the cooling apparatus 1B restricts the flow rate of the cooling water that flows through the head side W/J 521B by controlling the flow rate control valve 14 capable of suppressing the cooling capacity of the cylinder head 52B without suppressing the cooling capacity of the cylinder block 51B. Thus, the cooling apparatus 1B is capable of maintaining cooling of the cylinder 51*a*, and thus suppressing the occurrence of knocking.

The cooling apparatus 1B is capable of controlling the flow rate of the cooling water that flows through the block side W/J 511B to enhance the cooling capacity of the cylinder block 51B when the flow rate control valve 14 controls the flow rate of the cooling water that flows through the head side W/J 521B to suppress the cooling capacity of the cylinder head 52B. Thus, the cooling apparatus 1B is thus capable of cooling intake air more effectively and suppressing the occurrence of knocking reliably.

Further, in the cooling apparatus 1B, when the engine is operating at low-speed, high-load conditions, the switch valves 21 and 22 are controlled to the circumferential-direction side of the cylinder 51*a*, so that the thermal conductivity from the cylinder block 51B to the cooling water can be enhanced. Thus, the cooling apparatus 1B is capable of cooling intake air much more effectively and suppressing the occurrence of knocking more reliably.

The cooling apparatus 1B is capable of improving the thermal efficiency at low-speed, high-load conditions and establishing the operations of the engine 50B under other operating conditions. Thus, the cooling apparatus 1B is capable of improving the thermal efficiency not only under specific operating conditions but also in the whole regular operations of the engine 50B.

The above-described embodiments are preferable embodiments of the present invention. However, the present invention is not limited to the above-mentioned embodiments, but other embodiments and variations may be made without departing from the scope of the present invention.

For example, the above-described embodiments have explained an exemplary case where the W/P 11 is the cooling medium pumping means because the operating conditions of the engines 50A and 50B may suitably be established. However, the present invention is not limited to this. For example, the cooling medium pumping means may be a mechanical W/P that is driven by the output of the engine.

The controls by the control means under the engine idle conditions, engine cold conditions or engine startup conditions are note limited to the above-described embodiments. For example, the cooling apparatus may further include a heat storage cooling medium feed means which can supply the first and second cooling medium passageways with the heat storage cooling medium. The control means may control the heat storage cooling medium feed means to supply the first and the second cooling medium passageways with the heat storage cooling medium, when the engine is under the idle conditions, or when the temperature of the heat storage cooling medium is higher than that of the cooling medium under the engine cold conditions or startup conditions. For example, the heat storage cooling medium feed means corresponds to a heat exchanger disclosed in the Japanese Patent Application Publication No. 2009-208569.

Further, in this case, the control means may control the part cooling capacity adjusting means is provided for corresponding to the spark plug or the exhaust port, among the part cooling capacity adjusting means which cool partially the cooling capacity of the cylinder head, so as to control the increase in the flow rate of the heat storage cooling medium.

This can accelerate the engine warming up, reduce the unburned HC, and improve the ignition property. Consequently, the engine operation can be preferably ensured.

In the aforementioned Embodiment 2, a description was given of an exemplary case where the third recess/projection portion P3 is combined with the flow rate control valve 14 as cooling capacity control means. However, the present invention is not limited to this, the recess/projection portion that varies the thermal conductivity to the cooling water from the cylinder block in response to change of the flow direction of the cooling water may be applied in combination with another cooling capacity control means capable of controlling the cooling capacity of the cylinder head (for example, W/P 11, the flow rate control valve 14 and the first recess/projection portions P1 in Embodiment 1).

Further, it is rational that the control means is achieved by each ECU 70 mainly controlling the engines 50A and 50B. For example, the control means may be realized by a hardware such as another electronic controller, an exclusive electronic circuit, or any combinations thereof. Furthermore, for example, the control means may be achieved, as a distributed control means, by hardware such as multiple electronic controllers and plural electronic circuits or a combination of hardware such as an electronic controller and an electronic circuit.

DESCRIPTION OF REFERENCE NUMERALS

1 cooling apparatus
11 W/P
12 radiator
13 thermostat
14 flow rate control valve
21 inlet side switch valve
22 outlet side switch valve
50A, 50B engine
51A cylinder block
51*a* cylinder
511 block side W/J
52A, 52B cylinder head
52*a* intake port
52*b* exhaust port
521 head side W/J
61, 62, 63, 64 partial flow rate control valves
70 ECU

The invention claimed is:

1. An engine cooling apparatus comprising:

an engine having a cylinder block having a cooling medium passageway in the periphery of a cylinder, a recess/projection portion capable of changing a thermal conductivity to a cooling medium in accordance with a change of a flow direction of the cooling medium being provided in the cooling medium passageway;

a cooling capacity control valve capable of controlling a cooling capacity of a cylinder head of the engine;

a flow direction changing valve capable of changing the flow direction of the cooling medium in the cooling medium passageway between a first direction and a second direction having a higher thermal conductivity due to the recess/projection portion; and a control unit for performing a control of suppressing the cooling capacity of the cylinder head by controlling the cooling capacity control valve and changing the flow direction of the cooling medium in the cooling medium passageway by controlling the flow direction changing valve when the operating conditions of the engine are low-speed, high-load conditions.

* * * * *